United States Patent [19]

Walker

[11] Patent Number: 4,941,663

[45] Date of Patent: Jul. 17, 1990

[54] TENNIS SERVICE CATCHING NET

[76] Inventor: MacQuarrie Walker, 25 Nortontown Rd., Madison, Conn. 06433

[21] Appl. No.: 343,502

[22] Filed: Apr. 26, 1989

[51] Int. Cl.[5] ..... A63B 69/00

[52] U.S. Cl. ..... 273/29 A

[58] Field of Search ..... 273/29 A, 29 B, 29 BB, 273/55 R, 128 A, 127 B

[56] References Cited

U.S. PATENT DOCUMENTS

| | | | |
|---|---|---|---|
| 1,116,554 | 11/1914 | Boggis | 273/411 |
| 3,980,299 | 9/1976 | Brown | 273/29 B |
| 3,982,758 | 9/1976 | Howes, Jr. . | |
| 4,030,733 | 6/1977 | Merrihew et al. . | |
| 4,088,317 | 5/1978 | Gierla . | |
| 4,192,503 | 3/1980 | Karas | 273/29 A |
| 4,204,679 | 5/1980 | Kreuzman . | |
| 4,456,252 | 6/1984 | Hartland . | |
| 4,523,760 | 6/1985 | Bednarczuk . | |
| 4,834,377 | 5/1989 | Weiss | 273/29 A |

FOREIGN PATENT DOCUMENTS

| | | | |
|---|---|---|---|
| 271484 | 4/1964 | Austria | 273/29 A |

*Primary Examiner*—Theatrice Brown

*Attorney, Agent, or Firm*—Delio & Associates

[57] ABSTRACT

A service catching device for a tennis court comprising a pair of frame sections, each having a pair of upstanding edges and a pair of horizontal edges, the frame sections being joined along an upstanding edge perpendicular to each other to form a "L" shape as seen in plan view. One of the frame sections has horizontal edges longer than the other of the frame sections. Netting is secured between the upstanding and horizontal of each of the frame sections to prevent a tennis ball from passing through the frame sections. The frame section having the longer horizontal edges is placed along the rear line defining the tennis court service area while the frame section having the shorter horizontal edges is placed along the outside line defining the tennis court service area. The frame sections and associated netting are adapted to retain tennis balls served into the service area from the opposite side of the tennis court.

16 Claims, 2 Drawing Sheets

TENNIS SERVICE CATCHING NET

BACKGROUND OF THE INVENTION

The present invention relates to a device for catching tennis serves on a tennis court and, in particular, to a portable frame and netting assembly having sections adapted for positioning along the rear and outside service lines of a tennis service area.

Difficulties arise when one seeking to practice one's tennis serve attempts to do so without the assistance of a player or other helper on the receiving end of the tennis court. Even where good fencing surrounds the tennis court, it is necessary to retrieve tennis balls over a widely scattered area. Furthermore, the generally side-by-side disposition of tennis courts usually results in scattering of balls onto adjacent courts, to the annoyance of any players on those courts.

Notwithstanding the problem of retrieving served tennis balls, there is also the problem for the sole player practicing his or her serve in determining whether the serve drops in or out of the service area when the ball bounces close to one of the boundary lines. Even if the serve is determined to be good, there is also no present way to gauge how close the serve landed to the line.

The prior art discloses several attempts to overcome some of the problems discussed above. U.S. Pat. No. 4,204,679 to Kreuzman discloses a tennis practice serving net which utilizes a separate net which mounts atop a conventional tennis net separating the two sides of the court. The extra net contains openings which permit passage of serves through a restricted area which approximates the region over the net the ball must pass through in order to land in the service area. However, this practice serving net opening does not correspond precisely to the service area and, furthermore, blocks the player's normal view over the tennis net.

Hartland U.S. Pat. No. 4,456,252 discloses a tennis service practice court which utilizes fixed netting behind the rear service line. This practice court, which overcomes some of the problems in U.S. Pat. No. 4,204,679, has disadvantages in that it requires the construction of a special court and is not useful on existing tennis courts. Further, this practice court provides no guidance with regard to determining whether the ball falls inside or outside of the side service line.

Bearing in mind the deficiencies in the prior art, it is therefore an object of the present invention to provide a service catching device to permit a single tennis player to practice his or her tennis serve.

It is another object of the present invention to provide a service catching device which enables a player to determine whether the practice serve hits inside or outside of the rear and side service lines.

It is a further objection of the present invention to provide a tennis service catching device which enables a player to determine how close a serve has dropped with regard to the rear or side service lines.

It is yet another object of the present invention to provide a tennis service catching device which is portable and may be moved from one service area to another or from court to court.

It is a further object of the present invention to provide a tennis service catching device which is easily disassembled for storage or movement.

SUMMARY OF THE INVENTION

The above and other objects, which will be apparent to those skilled in the art, are achieved in the present invention which provides a service catching device for a tennis court comprising a pair of frame sections, each having a pair of upstanding edges and a pair of horizontal edges, the frame sections being joined along an upstanding edge perpendicular to each other to form a "L" shape as seen in plan view. One of the frame sections has horizontal edges longer than the other of the frame sections and preferably has a length which conforms substantially to the length of the rear line of an individual service area on a regulation size tennis court. Netting secured between the upstanding and horizontal of each of the frame sections restricts passage of a tennis ball through the frame sections. The frame section having the longer horizontal edges is adapted for placement along the rear line defining the tennis court service area while the frame section having the shorter horizontal edges is adapted for placement along the outside line defining the tennis court service area. The frame sections and associated netting are adapted to retain tennis balls served into the service area from the opposite side of the tennis court.

DETAILED DESCRIPTION OF THE INVENTION

Figure 1:
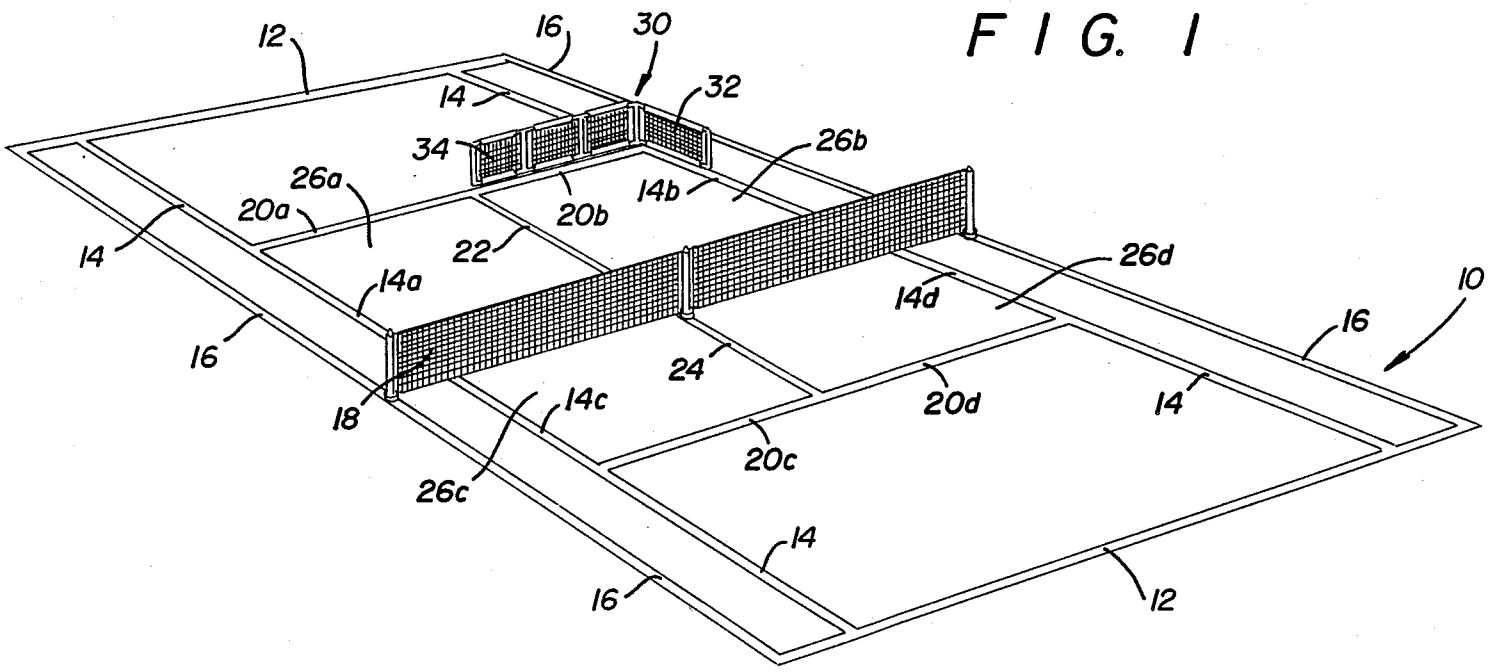
FIG. 1 is a perspective view of the service catching device of the present invention installed on a standard, regulation size tennis court.

The present invention is shown in FIG. 1 in use on a standard regulation tennis court 10. The tennis court surface is marked by base lines 12 defining the ends of the court and doubles sidelines 16 defining the sides of the court. Parallel to and within the doubles sidelines lie the singles sidelines 14. Tennis net 18 bisects the court 10 midway along the sidelines 14 and 16.

The standard service areas of the court 10 lie between the singles sidelines 14 and are further marked by rear service line **20*a* and 20*b* on one side of net 18 and rear service lines 20*c* and 20*d* on the opposite side of net 18. Center lines 22 and 24 divide the service areas into right and left hand side service areas on each side of net 18**, respectively.

On the side of court 10 on the far side of net 18 as seen in FIG. 1, right side service area (as seen facing the net) **26*a* is bounded by a portion of net 18, center line 22, rear service line 20*a* and outside service sideline 14*a*. Left side service area 26*b* is bounded by another portion of net 18, center line 22, rear service line 20*b* and outside service sideline 14*b*. On the near side of court 10, right service area 20*d* is bounded by a portion of net 18, center line 24, rear service line 20*d* and outside service sideline 14*d*. Left side service area 26*c* is bounded by a portion of net 18, center line 24, rear service line 20*c* and outside service sideline 14*c***.

FIG. 1 illustrates the service catching device 30 of the present invention as it would be used by a player practicing service from the left hand side of the near portion of court 10 to the left hand service area **26*b* on the far side of the court. Service catching device 30** comprises two main sections—a relatively short side section 32 and a perpendicularly disposed longer back section 34. As seen in a top plan view, the two sections form an "L" shape. As will be explained in more detail later, side section 32 is disposed alongside and slightly outside of outside service sideline 14*b* while back section 34 is disposed alongside and slightly behind rear service line 20*b*.

Figures 2, 3:
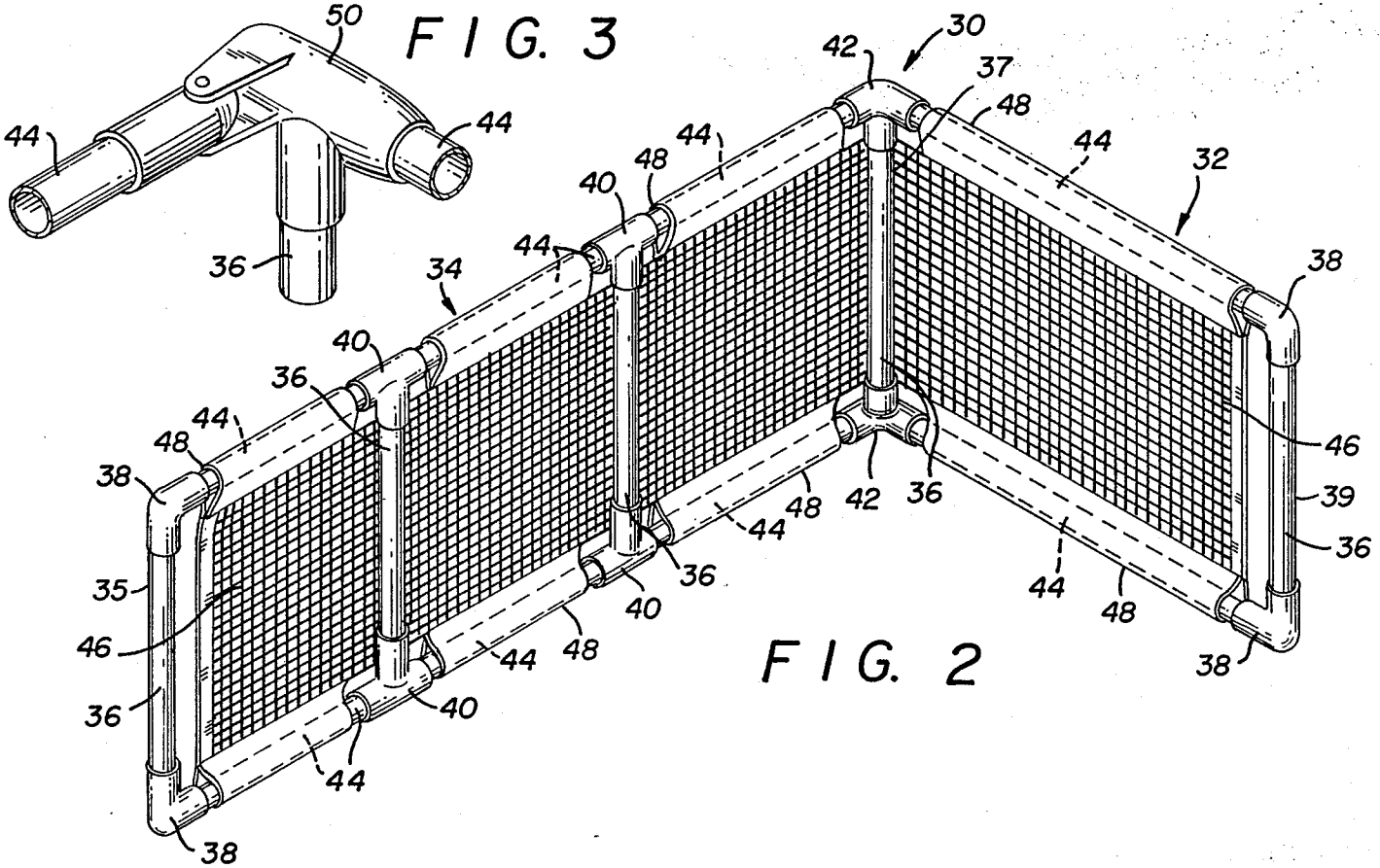
FIG. 2 is a perspective view of the service catching device shown in FIG. 1.
FIG. 3 is a close up of an alternate embodiment of a corner fitting of the device of FIG. 2.

Service catching device 30 is shown in a close up view in FIG. 2. Each section 32 and 34 is comprised of frame members made of rigid PVC tube or the like. Side section 32 includes upstanding vertical posts 36 and upper and lower horizontal tube members 44. Along the free end 39 of side section 32, post 36 is connected at its top and bottom to the horizontal members 44 by tube elbow connecting sections 38. At the opposite end 37 of side 32, post 36 is connected to tube members 44 by three legged corner sections 42. Corner tube sections 42 also serve to connect to horizontal members 44 which form part of back section 34.

Back section 34 includes a plurality of upstanding posts 36, and, although four (4) posts 36 are shown as forming part of back section 34 (including one corner post on end 37 common to side section 32), any number can be used as long as there is provided proper rigidity and support for the rear section. It is contemplated that an alternate embodiment may include only 3 of such posts, i.e., only one center post in back section 34. The two center posts 36 of back section 34 are connected at their upper and lower ends to upper and lower horizontal members 44 by "T" tube connecting sections 40. The free end 35 of back section 34 includes vertical post 36 joined to the upper and lower horizontal members 44 by elbow tube sections 38.

The various connecting tube sections 38, 40 and 42 may be secured to the posts 36 and horizontal members 44 by any suitable means, for example, screws or other fasteners, adhesives, compression fitting or the like. For purposes of portability and easy movement and storage, it is preferred that the embodiment shown in FIG. 2 include releasable securing means on common section end 37 between corner tube sections 42 and the horizontal tube members 44 on one or another of the side and back sections 32 and 34, respectively.

To prevent a tennis ball from passing through the service catching device 30, there is provided a flexible sheetlike material which is secured between the various frame members comprising the device 30. The flexible sheetlike material may be the conventional-type netting 46, for example, the same type used in a standard tennis net 18, as long as it provides closely spaced cords to restrict the passage of a fast-moving tennis ball therethrough. Any other suitable woven or sheet-like material may be employed in place of netting. Netting is preferred because it is durable, relatively inexpensive, and does not unduly block vision. The netting 46 is bounded along its edges on all sides by durable lightweight cloth sleeves 48 which slip over the tube members to secure the netting to the frame.

In the preferred embodiment shown, the length of back section 34 is approximately thirteen and one-half feet long to correspond to the length of the individual rear service lines 20*a*, 20*b*, 20*c* and 20*d* (FIG. 1). Back section 34 may be longer, but it would be of little advantage unless the present invention is to be used for more than one service area at a time. Side section 32 can be of any length, but is preferably shorter than the length of rear section 34 since, in practice, it has not been found necessary to have the side section extend all the way up the side service lines (14*a*, 14*b*, 14*c* or 14*d*) to net 18. A preferred length of side section 32 has been found to be approximately four and one half feet, although this dimension can be varied to provide a device best suited to catch a majority of practice serves.

The height of the preferred service catching device 30 is preferably in excess of three (3) feet and more preferably is about 42 inches, or such other height which is determined to be best suited to catch a majority of practice serves. Netting 46 preferably has a vertical dimension longer than the height of the frame for the service catching device 30 to provide some slack. A suitable length has been found to be approximately 6 to 10 inches more than the height of the frame. Other net height dimensions may be selected to be best suited to adjust the bounce back of a tennis ball striking the net 46.

In use, service catching net 30 is placed adjacent to the rear and outside service lines of a desired service area. As shown in FIG. 1 in use with service area 26*b*, a player standing behind base line 12 on the left side of the near section of the court 10 will attempt to hit a practice serve onto service area 26*b*. By positioning device rear section 34 slightly behind the rear service line and the side section 3 slightly outside of the outside service line, a player may tell whether the practice serve was good or not by listening to the sounds made by the tennis ball. The tennis ball will make a different sound depending on whether it has hit the court 10 surface or the service catching device 30. If there is the sound of the ball hitting the net or one of the device frame members, the ball would have hit outside the service area and would be a "fault". If the net 46 is strung loosely enough, the sound may be absorbed by the netting. If the tennis ball hits successfully within the service area, it will bounce on court 10 and make a distinctive first sound and then make a second sound when it hits the netting (depending on how tightly the netting is strung). Depending on how far apart the sounds are, the server will have an approximate idea of how close to the line the serve has landed.

The frame for service catching device 30 can be made of plastic or metal pipe or other material rigid enough to support the net. Preferably, it will be made of lightweight material so as to be portable and easily moved from one service area to another or from court to court. In the view shown in FIG: 1, a person wishing to practice a serve from the right hand side of near base line 12 into opposite service area 26*a* will merely have to flip the service catching device over so that the back section 34 is alongside rear service line 20*a* and the side section 32 is alongside outside service sideline 14*a*.

In the embodiment shown in FIG. 2, the service catching device 30 may be disassembled for movement or storage by removing the horizontal tubes 44 from corner tube sections 42 on either the side section 32 or back section 34. In an alternate embodiment, a hinged connector may be substituted for corner sections 42, such as the hinged member is shown in FIG. 3 comprising a hinged corner section 50 which connects the horizontal tube members 44 and vertical corner post 36. With either embodiment, side section 32 may be folded down adjacent to back section 34 for easy moving and/or storage of the device 30.

While this invention has been described with reference to specific embodiments, it will be recognized by those skilled in the art that variations are possible without departing from the spirit and scope of the invention, and that it is intended to cover all changes and modifications of the invention disclosed herein for the purposes of illustration which do not constitute departure from the spirit and scope of the invention.

Having thus described the invention, what is claimed is:

1. A service practice court for tennis comprising:
a tennis net; a regulation service area having rear and outside service lines on one side of said tennis net; a regulation base line on the other side of said tennis net; and a service catching device comprising
a first frame section having vertical members defining the ends of said first section and at least one horizontal member connecting said vertical members,
said first frame section having a horizontal length substantially the same as that of, and disposed along, the rear line of an individual regulation tennis court service area;
a second frame section, adjacent to said first frame section, having vertical members defining the ends of said second section and at least one horizontal member connecting said vertical members, said second frame section having a horizontal length less that of said first frame section and disposed along a portion of the outside line of said service area, said first and second frame sections being secured perpendicular to each other along a common vertical edge and having opposite free ends to form an "L" shape as seen in plan view; and
a sheet material secured within each of said frame sections to restrict passage of a tennis ball,
said frame sections and associated sheet material adapted to retain tennis balls served into said service area from the opposite side of said tennis court.

2. The service practice court of claim 1 wherein said frame sections and associated sheet material are portable.

3. The service practice court of claim 2 wherein said frame sections comprise discreet members which may be disassembled for movement or storage of said device.

4. The service practice court of claim 3 wherein said frame sections are removably secured along a common upstanding edge for disassembly during moving or storage.

5. The service practice court of claim 4 wherein said frame sections are hingeably connected along a common upstanding edge for moving or storage.

6. The service practice court of claim 5 wherein the upstanding edges of said frame sections are at least 3 feet in height.

7. The service practice court of claim 6 wherein said sheet material is loosely strung within said frame to reduce bounce back of a tennis ball hitting said sheet material.

8. The service practice court of claim 7 wherein said sheet material is netting.

9. A service practice court for tennis comprising:
a tennis net; a regulation service area having rear and outside service lines on one side of said tennis net; a regulation base line on the other side of said tennis net; and a service catching device comprising
a first frame section having vertical members defining the ends of said first section and at least one horizontal member connecting said vertical members, said first frame section having a horizontal length substantially the same as that of, and disposed along the rear line of an individual regulation tennis court service area;
a second frame section, adjacent to said first frame section, having vertical members defining the ends of said second section and at least one horizontal member connecting said vertical members, said second frame section having a horizontal length less that of said first frame section and disposed along a portion of the outside line of said service area, said first and second frame sections being secured perpendicular to each other along a common vertical edge and having opposite free ends to form an "L" shape as seen in plan view; and
a sheet material secured within each of said frame sections to restrict passage of a tennis ball,
a said frame sections and associated sheet material adapted to retain tennis balls served into said service area from the opposite side of said tennis court, said frame sections being further adapted to be folded adjacent one another for moving or storing of said device.

10. The service practice court of claim 9 wherein said frame sections and associated sheet material are portable.

11. The service practice court of claim 10 wherein said frame sections comprise discreet members which may be disassembled for movement or storage of said device.

12. The service practice court of claim 11 wherein said frame sections are removably secured along a common upstanding edge for disassembly during moving or storage.

13. The service practice court of claim 12 wherein said frame sections are hingeably connected along a common upstanding edge for moving or storage.

14. The service practice court of claim 13 wherein the upstanding edges of said frame sections are at least 3 feet in height.

15. The service practice court of claim 14 wherein said sheet material is loosely strung within said frame to reduce bounce back of a tennis ball hitting said sheet material.

16. The service practice court of claim 15 wherein said sheet material is netting.

* * * * *